United States Patent [19]

Gilbert

[11] 4,250,992

[45] Feb. 17, 1981

[54] RETURNABLE BEVERAGE CARRIER

[75] Inventor: Earl F. Gilbert, Farmington Hills, Mich.

[73] Assignee: Westvaco Corporation, New York, N.Y.

[21] Appl. No.: 62,986

[22] Filed: Aug. 2, 1979

[51] Int. Cl.[3] ..... B65D 5/46; B65D 5/48

[52] U.S. Cl. ..... 206/162; 206/188; 206/198; 229/28 BC; 229/52 BC

[58] Field of Search ..... 206/162, 198, 427, 195, 206/188; 229/52 B, 28 BC, 52 BC, 15, 34 R

[56] References Cited

U.S. PATENT DOCUMENTS

| | | | |
|---|---|---|---|
| 2,698,125 | 12/1954 | Vizcarrondo et al. | 229/52 B |
| 2,850,223 | 9/1958 | Strauss | 229/27 |
| 2,914,235 | 11/1959 | Jones | 229/34 R |
| 3,547,339 | 12/1970 | Bruce | 229/52 B |
| 3,756,499 | 9/1973 | Giebel et al. | 229/34 R |
| 3,784,053 | 1/1974 | Stout | 229/52 BC |

*Primary Examiner*—William T. Dixson, Jr.

[57] ABSTRACT

A returnable beverage bottle carrier is prepared from a one-piece blank of corrugated paperboard or the like without the aid of stitching, gluing or stapling. The carrier is in tray form with a handle that divides the carrier into two equally sized carrying compartments, and has three thicknesses of material on each of its four sides, a double thick bottom and a handle portion of at least two thicknesses.

3 Claims, 2 Drawing Figures

RETURNABLE BEVERAGE CARRIER

BACKGROUND OF INVENTION

The present invention relates generally to paperboard trays, and more particularly to a paperboard carrier for beverage bottles of the returnable type.

It is well known to construct beverage carriers of the type disclosed herein from a single blank of material. Moreover, it is also common to provide such carriers with an integral handle. Furthermore, there is a well known need for constructing such carriers of sufficient strength to enable them to withstand the rigors of reuse. And finally, there is a clear need for designing such carriers so that they can be readily and easily set up at the point of use without the need for additional assembling equipment.

In this regard, the current trend toward the use of returnable beverage bottles and the desirability of packaging as many bottles as possible in the same carrier has resulted in the development of paperboard trays that are capable of carrying six, eight and even twelve bottles in a single carrier. An example of such a carrier is illustrated in U.S. Pat. No. 3,784,053, which discloses a basket style carrier for twelve bottles arranged in four rows, two rows on each side of a centrally located handle. Meanwhile, U.S. Pat. No. 2,850,223 discloses a reusable carrier that is constructed from multiple thicknesses of the carrier material, and U.S. Pat. No. 3,547,339 discloses a bottle carrier that is set up without the aid of staples or the like. However, no single prior art patent discloses each of the advantageous features together particularly with the results achieved by applicant herein.

SUMMARY OF INVENTION

The present invention has for its primary purpose the attainment of a reusable bottle carrier for returnable beverage bottles. Bottle carriers of the type disclosed herein must be strong and of rugged construction to withstand the rough treatment often encountered during use, but they are also desirably constructed in such a manner that they can readily be assembled for use and disassembled if need be for storage. Moreover, in order to be cost effective yet still manageable by the consumer, the carriers should be large enough to accomodate as many bottles as feasibly possible.

Accordingly, in order to satisfy these various desires and requirements, the bottle carrier of the present invention is designed to accommodate up to twelve nominally sized bottles for the sake of convenience; it is preferably fabricated from a single blank of cut and scored corrugated paperboard to give it rugged construction; it is formed with at least three thicknesses of the corrugated material in each of its side walls; at least two thicknesses of the material in its bottom; at least two thicknesses of the material in its integral handle; and, the blank from which the carrier is constructed is designed to be readily and conveniently set up for use without the use of additional tools or fastening means. In its preferred embodiment, the bottle carrier according to the present invention is prepared from a one piece blank of corrugated paperboard that is pretreated to make it substantially weather resistant and impervious to the elements. For this purpose the paperboard blank may be curtain coated with a water repellent waxy material or it may be constructed from paper components that are specially treated to resist the penetrating effects of moisture. An example of such paper is Westvaco's "Cote-A-Cor 600" wax impregnated, curtain coated paperboard, described fully in U.S. Pat. No. 2,982,333.

The one piece blank in its preferred form includes a rectangularly shaped centrally located outer bottom panel which has outer side and end walls foldably attached to the edges thereof. The outer side walls also include integral inner side walls and inner bottom panels foldably attached to the outer edges thereof and intermediate end walls foldably attached to the ends thereof. Meanwhile, the outer end walls each include integral inner end walls foldably attached to the outside edges thereof and intermediate side walls foldably attached to the ends thereof. And finally, the intermediate side walls include at least a pair of integral partition/handle portions located on two diagonally opposed corners of the blank with it being understood that such partition/-handle portions may be included at each corner of the blank. Thus, a carrier constructed from the blank just disclosed comprises a pair of carrying compartments on each side of a partition/handle portion of sufficient size to accomodate up to at least twelve returnable bottles of conventional twelve ounce size. The partition/handle portions are arranged between the side walls of the carrier and consist of at least two thicknesses of the blank material, while the side and end walls consist of at least three thicknesses of blank material, and the bottom panel consists of at least two thicknesses of blank material.

Accordingly, while only a single embodiment of the invention has been described, the nature of the invention will be more clearly understood by reference to the following detailed description and the accompanying drawings.

DETAILED DESCRIPTION

Figure 1:
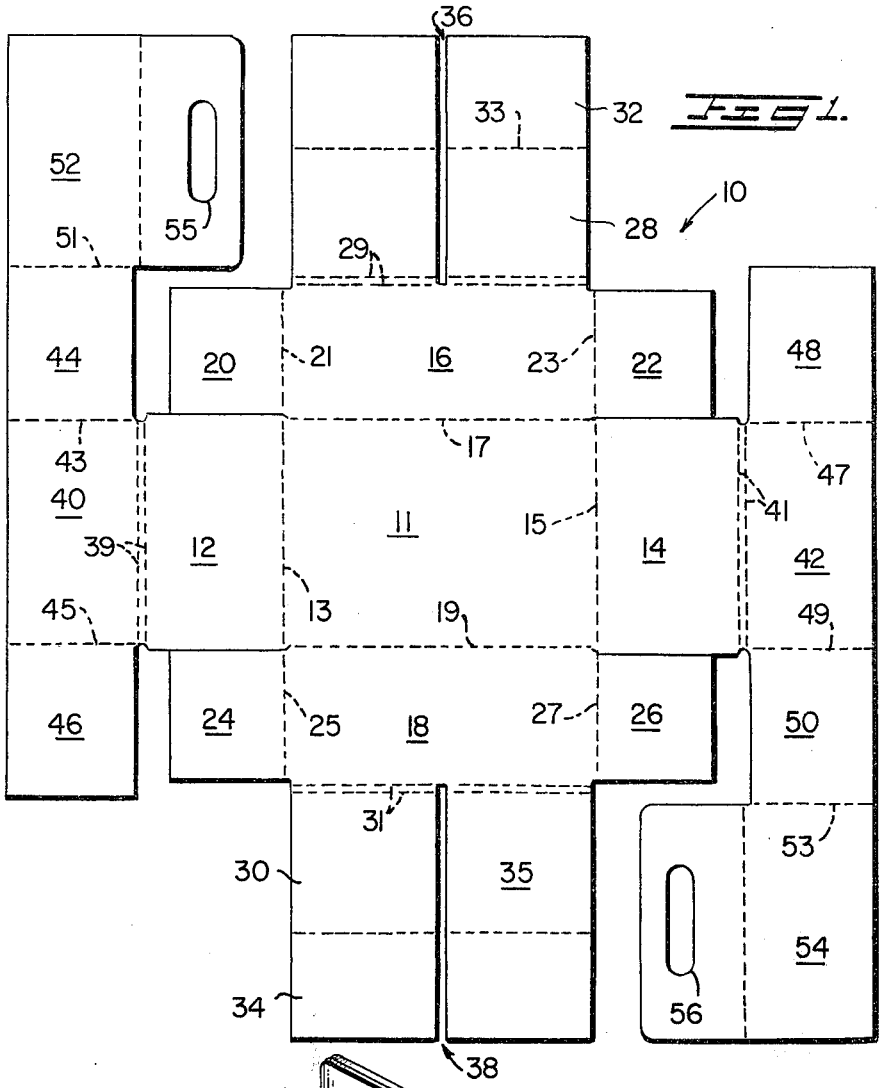
FIG. 1 is a plan view of a typical blank construction for fabricating the carrier of the present invention; and, FIG. 2 is a top perspective view of the carrier formed from the blank of FIG. 1.
Figure 2:
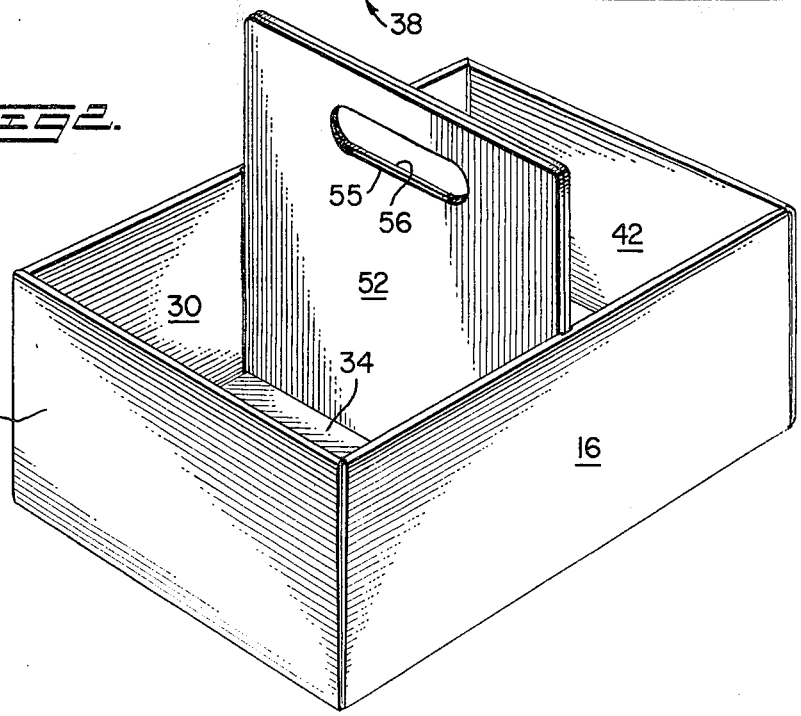

Referring now to the drawing, and especially to FIG. 1, there is shown a one piece blank 10 of generally rectangular configuration wherein the different panels of the blank are substantially symmetrically arranged around a centrally located bottom panel 11. The bottom panel 11 is of generally rectangular shape and is bounded at its outer edges by a pair of end walls 12,14 along score lines 13,15 respectively, and a pair of side walls 16,18 along score lines 17,19. The bottom panel 11, end walls 12,14 and side walls 16,18 each form the outer walls of the carrier when it is set up for use. Meanwhile, the side walls 16,18 each include intermediate end walls 20,22,24 and 26 foldably attached to the ends thereof along score lines 21,23,25 and 27, and second or inner side walls and bottom panels foldably attached to the outside edges thereof. For instance, an inner side wall 28 is foldably attached along the paired score lines 29 to the outer side wall 16, and another inner side wall 30 is foldably attached along the paired score lines 31 to the outer side wall 18. In addition, a pair of inner bottom panels 32,34 are foldably attached to the inner side walls 28,30 along scored lines 33,35. However, because the integral partition/handle portions of the carrier extend between the side walls 16,18 the inner side walls 28,30 and the inner bottom panels 32,34 are each notched at 36,38 to accept the partition/handle portions and provide an effective friction lock for maintaining the various panels and walls in place. The width of the notches 36,38 depends upon the thickness of the blank material and the number of partition/handle portions utilized.

At the two opposed sides of the blank 10, additional panels are provided which form inner end walls, intermediate side walls and the integral partition/handle portions. For instance, a pair of inner end walls 40,42 are foldably attached to the ends of the outer side walls 12,14 along paired fold lines 39 and 41 respectively. The paired scorelines 39,41 are necessary to permit the end walls to fold around the intermediate end walls 20,22,24 and 26 when the carrier is assembled. Meanwhile, a pair of intermediate side walls 44,46 are foldably attached to the ends of inner end wall 40 along the score lines 43,45 and a pair of intermediate side walls 48,50 are foldably attached to the ends of the inner end wall 42 along the score lines 47,49. And, finally the blank is completed with at least one pair of partition/handle elements 52 and 54 which are foldably attached to the ends of two diagonally oriented intermediate side walls 44,50 along score lines 51,53. The carrier is preferably designed to have at least one pair of partition/handle elements 52,54 for added strength. However, if desired the blank 10 could be provided with partition/handle elements attached to each of the intermediate side walls 44,46,48 and 50 (not shown) where even greater handle strength is required.

The blank 10 is set up and folded into its carrier configuration substantially as follows. First, the outer side and end walls 12,14 and 16,18 are squared around the outer bottom panel 11. The intermediate end walls 20,22,24,26 are folded inwardly and the inner end walls 40 and 42 are folded around to capture the intermediate end walls 20,22,24 and 26. Simultaneously, the intermediate side walls 44,46 and 48,50 are also folded to lie inside of and adjacent to the previously squared outer side walls 16,18. As this folding sequence is taking place, the integrally attached partition/handle portions 52,54 are also folded so as to lie adjacent to one another and are oriented between the side walls 16,18. Where additional partition/handle portions are added to the blank at the opposite intermediate side walls 46,48 (not shown), the folding sequence becomes a little more complicated but is still readily achievable.

After the partition/handle portions 52,54 are properly oriented from side-to-side, the locking inner side and bottom panels 28,30 and 32,34 are folded around to capture the intermediate side walls 44,46 and 48,50. In doing so, the slots 36,38 also capture the partition/handle portions 52,54 and serve to lock the various panels and flaps of the carrier into their proper location. This sequence assures that the handle hole cutouts 55,56 in the partition/handle portions 52,54 become aligned and remain available for picking up and transporting the carrier.

It will thus be seen that the carrier is effectively constructed from a one piece blank without the aid of staples, glue or other fastening means. The dimensions of the various panels and walls are such that two compartments are formed by the integral partition/handle portions of sufficient size to accomodate up to twelve returnable bottles. Moreover, because the carrier is prepared from fairly heavy weight corrugated paperboard, it is readily reusable and even capable of being disassembled to its flat condition where desired.

Accordingly while only one specific embodiment has been fully described herein, it will be understood that different details of construction may be resorted to within the spirit of the appended claims.

I claim:

1. A substantially rectangular blank of corrugated paperboard or the like for forming a returnable bottle carrier including an integral handle which divides the carrier into two equally sized carrying compartments, said blank comprising, a rectangular outer bottom panel located substantially centrally of said blank, a pair of outer end walls foldably attached to two opposed edges thereof, a pair of inner end walls foldably attached to the free edges of said outer end walls, a plurality of intermediate side walls foldably attached to the ends of said inner end walls, at least one pair of partition/handle panels each of which contain matching handhole cutouts foldably attached to diagonally opposed intermediate side walls at each side of the blank, a pair of outer side walls foldably attached to the remaining opposed edges of said rectangular outer bottom panel, a plurality of intermediate end walls foldably attached to the ends of said outer side walls, a pair of inner side walls and a pair of inner bottom panels foldably attached to the free edges of said inner side walls, the improvement wherein said blank contains a pair of slots at opposite sides thereof, which slots are of a width that is substantially equal to the thickness of said blank material multiplied by the number of partition/handle panels associated with said blank, and which slots substantially bisect the opposed inner side walls and inner bottom panels into equally sized pairs to form friction locks for the carrier blank.

2. A returnable bottle carrier prepared from a single blank of corrugated paperboard material or the like without the aid of staples, glue or other fastening means and characterized as being divided into two compartments by an integral partition/handle member, the improvement wherein, the side walls of said carrier comprise at least three thicknesses of material, consisting of a first full sized outer side wall panel, a pair of intermediate side wall panels which together form a full sized intermediate side wall and which are arranged to lie adjacent to the inside of said outer side wall panel, and a pair of inner side wall panels which together form a full sized inner side wall and which are arranged to be folded over said intermediate side wall panels to retain them in position, the end walls of said carrier comprise at least three thicknesses of material consisting of a first full sized outer end wall panel, a pair of intermedite end wall panels which together form a full sized intermediate end wall and which are arranged to lie adjacent to the inside of said outer end wall panel, and a pair of inner end wall panels which together form a full sized inner end wall and which are arranged to be folded over said intermediate end wall panels to retain them in position, the bottom wall comprises at least two thicknesses of material consisting of a first full sized outer bottom panel and a plurality of inner bottom panels which together form a second full sized inner bottom panel and the integral partition/handle member comprises at least two thicknesses of material formed by a pair of partition/handle panels which are foldably attached to at least two of said intermediate side wall panels so as to extend between the side walls of said carrier.

3. The carrier of claim 2 wherein the means for preparing said carrier without the aid of staples, glue or other fastening means comprises a friction lock formed by a pair of slots which divide the inner side wall and inner bottom panel into paired elements and which provide surfaces for gripping the sides of said partition/handle member.

* * * * *